United States Patent [19]

Shaw et al.

[11] 4,002,321

[45] Jan. 11, 1977

[54] TILTABLE DRUMS FOR WINDING HOIST LINES

[75] Inventors: John B. Shaw, Phoenix; Cecil T. Pelts, Glendale, both of Ariz.

[73] Assignee: Cecil A. Pelts, Phoenix, Ariz.

[22] Filed: July 7, 1975

[21] Appl. No.: 593,639

[52] U.S. Cl. ..... 254/184; 212/97; 242/158 R

[51] Int. Cl.[2] ..... B66D 1/26

[58] Field of Search ..... 254/186 R, 190 R, 184, 254/168, 183; 212/83, 84, 97, 98, 100, 14; 242/158 R; 182/142

[56] References Cited

UNITED STATES PATENTS

| | | | |
|---|---|---|---|
| 2,707,053 | 4/1955 | Browning | 254/184 |
| 2,998,094 | 8/1961 | Fisher | 254/186 R |
| 3,568,468 | 3/1971 | Dechantsreiter et al. | 254/184 |
| 3,690,409 | 9/1972 | Brauss | 254/186 R |
| 3,715,084 | 2/1973 | Weiss, Jr. | 254/186 R |

*Primary Examiner*—Frank E. Werner
*Assistant Examiner*—Kenneth Noland
*Attorney, Agent, or Firm*—Warren F. B. Lindsley

[57] ABSTRACT

An arrangement for one or more tiltable drums that may be used in conjunction with cranes or other hoisting devices to overcome fleet angle limitations and controls the point of cross-over and reversal of the winding of the running line due to fleet angle limitations of the line when the load bearing blocks are brought near their high limit.

9 Claims, 6 Drawing Figures

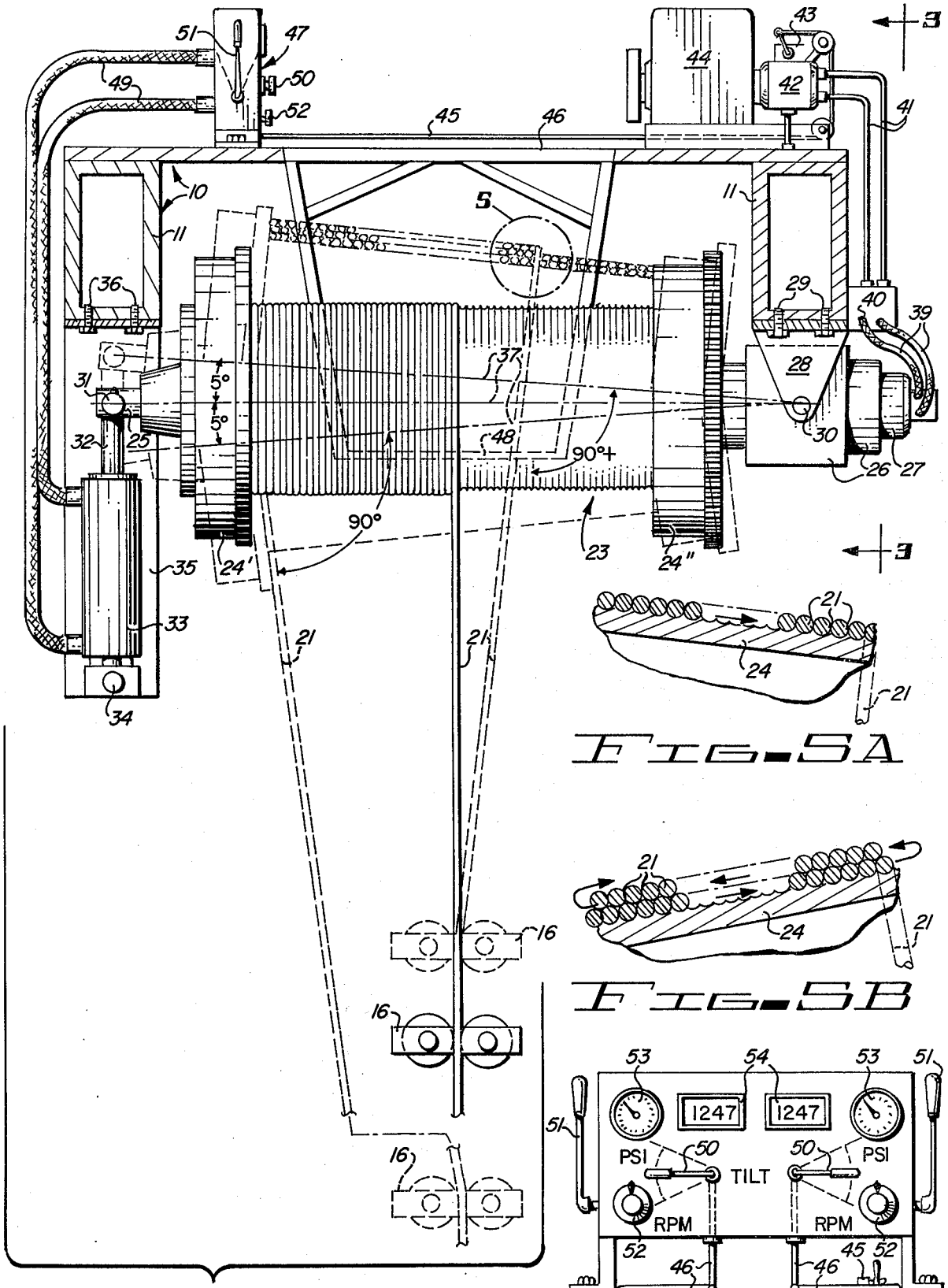
FIG-1
FIG-5A
FIG-5B
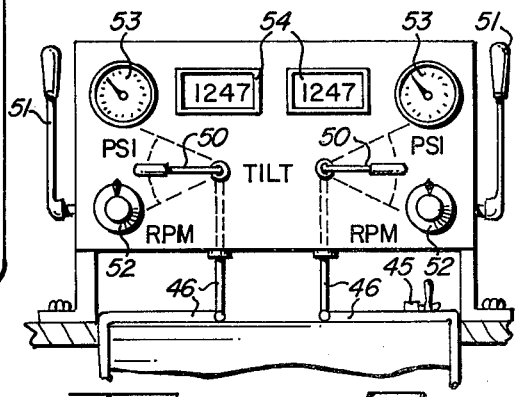
FIG-2

TILTABLE DRUMS FOR WINDING HOIST LINES

FIELD OF THE INVENTION

This invention relates to power driven rotatable drums of the multi-layer storage type and their supporting equipment normally utilized in conjunction with heavy duty hoisting devices for lifting and lowering large loads by winding or unwinding the load carrying running lines from the drums.

BACKGROUND OF THE INVENTION

Heretofore cranes or hoisting devices have used power driven rotatable storage drums mounted on a fixed horizontal axis near floor level adjacent the crane or on the structural frame of the same for lifting, transporting and lowering extremely heavy loads.

DESCRIPTION OF THE PRIOR ART

Fixed horizontal mounting of power driven drums of a crane structure present a few undesirable and dangerous conditions which may be eliminated or greatly reduced if uniform layers of rope or wire are wound in a tight parallel arrangement on the drum, thereby increasing the safety of the hoist operation and increased wire rope life. This ideal situation can only be obtained on conventional hoisting equipment by means of a "level wind" or automatic compensating device, that is either manually guided or mechanically associated with the drum's drive gears. Both methods increase original investment costs and operator supervision time as well as increasing friction in the hoisting equipment because of the additional sheaves required to guide the rope as it is spooled onto the drum.

The most efficient mechanisms of this type are adapted to wind the wire rope on the drum with vertically no deflections of any kind between the drum and the sheaves in the traveling lifting block which supports the hook and/or an equalizer beam of a hoisting structure. A "fleet angle" of approximately 1¼° (maximum) limits the approach of the traveling block to about 20 times the distance between the drum flanges. This is an impracticable requirement for a typical overhead crane that must bring the block up tight in close proximity to the top of the crane's boom or drum supporting frame structure in order to lift the load over obstacles while traveling horizontally. If this figure of 20 times the distance between drum flanges is reduced, excessive side scrubbing of the wire rope and random pyramiding and crossing of the same takes place resulting in a very dangerous and destructive condition in the hoisting equipment.

SUMMARY OF THE INVENTION

In accordance with the invention claimed an improved means is provided for winding or unwinding the running or load carrying lines of hoisting equipment on to or off of one or more power driven rotatable drums. This equipment employs a controlled, vertical tilting action of the drums to insure safe, speedy and efficient, high level lifting and lowering of the load by maintaining the alignment of the rotating axis of the drum or drums, normal to the line of pull during the complete lifting or lowering operation.

It is, therefore, one object of this invention to provide a new method of winding and unwinding wire or rope on the drums of hoisting equipment.

Another object of this invention is to provide improved hoisting apparatus employing power driven vertically tiltable wire rope winding drums providing accurately controlled winding alignment of the wire or rope on the drums.

Another object of this invention is to provide an improved pair of power driven rotatable wire rope winding drums installed in spaced horizontal relationship to each other on the frame girders of conventional cranes or the like, with one end of each unit pivoted on the vertical centerline of one frame girder and with the other end of each unit arranged and adapted to be tilted by a mechanism mounted on the vertical centerline of another opposite and parallel frame girder.

A further object of this invention is to provide improved hoisting equipment employing a pair of tiltable drums wherein the degree and direction of tilt of each individual drum unit, their speed and direction of rotation is controlled simultaneously from a remote control operator's console.

A still further object of this invention is to provide a pair of power driven tiltable, wire rope storage drums that are mounted in horizontal spaced relationship on the rigid frame of a hoisting crane or device with the running lines of each drum associated with the usual fixed sheaves, traveling block sheaves and fairlead sheaves of the crane in a conventional manner and in direct contact with the roller elements of a pair of odometers mounted in an instrument cluster on a remote control console, which measures and visually indicates simultaneously the line footage hauled in, or out, by which means, the operator, by keeping the numbers indicating the line footage in "cadence", may obtain absolute parallelism of the equalizer beam and the load, which is carried by the running lines.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which most of the basic elements are illustrated in diagramatic or schematic form and some of the elements common to conventional hoisting systems and their wire rope winding drums, such as the band brake, safety ratchet, safety brake, etc. have been deleted from the drawings for reasons of clarity.

FIG. 1 is a transverse sectional view through the parallel frame girders and one tie plate of a conventional, heavy duty crane or hoisting device showing one of the tiltable drum units of this invention and some of its related functional elements in side elevation installed on the frame structure of the crane.

FIG. 2 is a front face elevational view of the remote control console installed on the tie plate of the crane structure, showing the preferred arrangement of its indicating dials, control knobs and operating levers.

FIGS. 5A and 5B illustrate two enlarged fragmentary views taken in the general area of the circle 5 in FIG. 1 illustrating the change in direction of transverse travel of the wire rope coils on the drum when its angle of tilt is reversed.

DESCRIPTION OF THE PREFERRED EMBODIMENT

Figure 3:
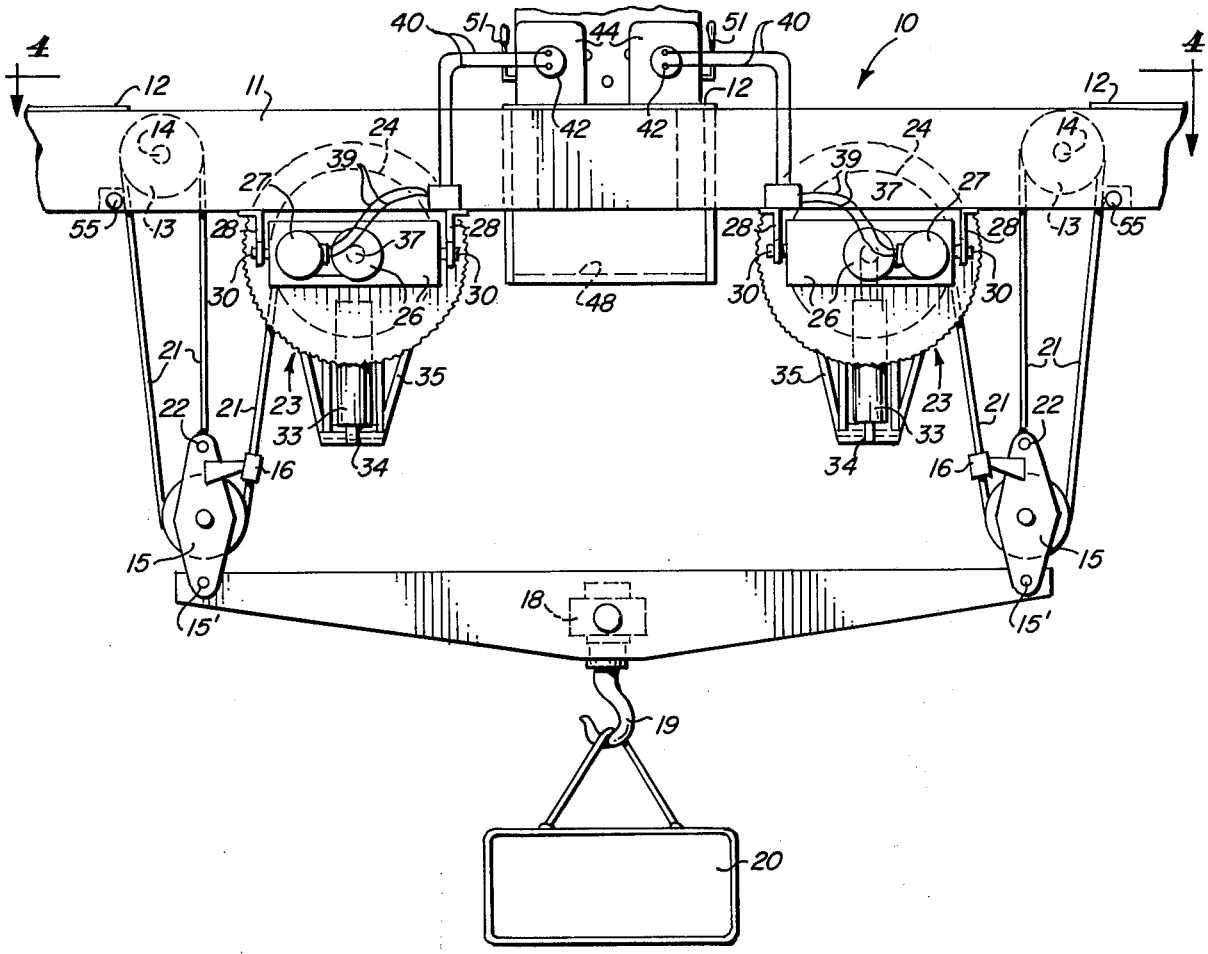
FIG. 3 is a longitudinal side elevational view of a portion of the parallel frame girders of the crane structure shown in FIG. 1 illustrating the installed relationship of the tiltable wire rope winding drum units of this invention with their running lines to the known fairlead sheaves, running blocks, fixed sheaves, equalizer beam and swivelling hook.
Figure 4:
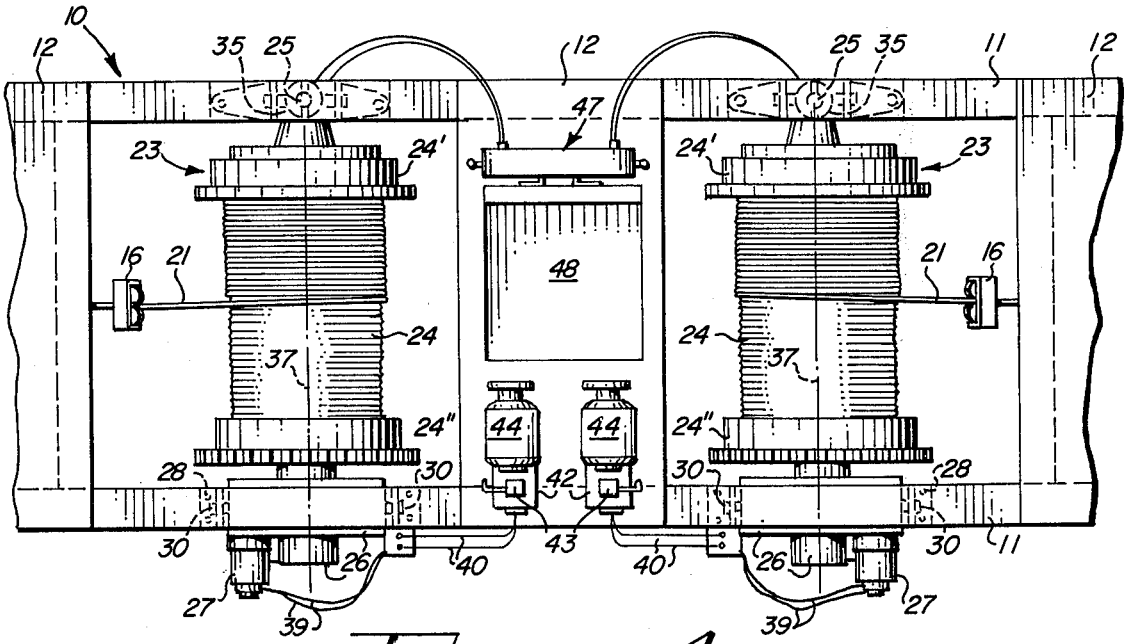
FIG. 4 is a plan view of the tiltable wire rope winding drum units shown in FIGS. 1 and 3 showing their relationship to the remote control console, operators platform, their respective power supply units and the hydraulic cylinders that perform the tilting function.

Referring more particularly by characters of reference, FIGS. 1, 3 and 4, illustrate a portion of the horizontal, uppermost cross beam assembly 10 typical of most heavy duty, high level, hoisting devices or cranes which comprises a pair of parallel spaced, longitudinally extending frame girders 11 that are joined together by suitable transverse box sections and flat cover plates 12, to form a rigid assembly.

Most heavy duty cranes or hoisting devices usually include a pair or more of fixed sheaves 13 that are rotatably mounted on transverse shafts 14 secured in parallel spaced relationship to the frame girders 11. A pair of vertically traveling blocks 15 may support fairlead sheave blocks 16 and by means of pivoted connections 15′ support the opposite ends of an equalizer beam 17. The equalizer beam 17 may be provided with a power driven rotating swivel 18 employing a lifting hook 19 that may be side shifted for accurate spotting of the load 20 carried thereon.

Such cranes or hoisting devices are usually provided with a pair of wire rope winding drums 24 that are mounted on parallel spaced, horizontally aligned shafts that extend transversely across the frame girders and are fixed thereto in rigid relationship. The drums are rotated in opposite directions by suitable power means through a reduction and reverse gear arrangement that is usually mounted on the cross beam assembly. The load is lifted or lowered by winding or unwinding the wire rope running lines 21 on or off of the drums. One end of the running lines is secured to the respective ends of the drums and threaded between the fairlead sheaves 16 around the large sheave in the traveling blocks 15, up and around the fixed sheaves 13 that are mounted on the transversely mounted shafts 14 in the frame girders 11 from which they extend downwardly to the top ends of the traveling blocks 15. At this point they are securely attached to cross pins 22 which are fixed in the bifurcated upper ends of blocks 15.

Because it is imperative that the portion of the running lines that is constantly moving between the fairlead sheaves 16 and the perimeter of the drum barrels be maintained in a normal (90° plus or minus 1¼°) relationship with the horizontal axes of the drums during the winding or unwinding operation to obtain optimum safety and long rope life with tight, parallel and uniform layers of rope on the drums, it is necessary to employ level wind devices or compensators. These devices are manually guided or mechanically integrated to the drums drive gears with conventional stationary or mobile hoisting equipment that utilizes wire rope winding drums that are rotatable about fixed horizontal axes. Since these devices increase investment costs, lower the efficiency of the hoisting system by creating additional friction on the running lines and sheaves and require more operator supervision time, it is desirable and advantagous to eliminate the need for this additional equipment and still be able to obtain equal or better results with an otherwise unobtainable high lift capacity. These results may be readily obtained by utilizing the improved design, construction and other features of the present invention described below.

Most of the components of a conventional crane or hoisting device, including the cross beam assembly 10, the pair of fixed sheaves 13, the pair of traveling blocks 15, the fairlead guide sheaves 16, equalizer beam 17 with a rotating swivel 18 and a lifting hook 19, and the wire rope running lines 21 are utilized in conjunction with the tiltable drum units 23 of the present invention. These drum units 23 are designed and built as integrated units which consist of drum 24, its shaft mounting 25, gear drive, (only the housing 26 of which is shown) band brake, safety ratchet, and safety brake (which are common to all such units and therefore not shown), and a hydraulic drive motor 27 so that all of these components move in unison in the same vertical plane when the drums are tilted.

The tiltable drum units are pivotally mounted at one end, in aligned spaced parallel, transverse relationship an equal distance from the center line of one of the transverse box section and cover plates 12 that are part of the cross beam assembly 10 by means of depending support brackets 28 of the exact length. The support brackets 28 are removably secured by bolts 29 to the underside of one of the parallel spaced longitudinally extending frame girders 11. Pivot pins 30 that extend outwardly from both sides of the gear box or housing 26 are adapted to support one end of the drum units 26 in horizontally and vertically aligned relationship with the vertical center of girder 11 and the depending support brackets 28 in which the pivot pins 30 are journaled.

The other or opposite ends of the tiltable drum units 23 are supported in tilting relationship at the extreme outer end of the extending, centrally disposed shaft mounting 25 by pivoted connections 31. Connections 31 are arranged at the upper ends of the reciprocating piston shafts 32 of suitable two way hydrualic cylinders 33. The bottom ends of these cylinders are pivotally supported on the vertical center line of the other parallel spaced frame girder 11 on pivot pins 34 that are secured in parallel, vertical relationship to the bottom ends of depending brackets 35. Brackets 35 are secured to the underside of that frame girder 11 by means of bolts 36 in such manner and relationship that the reciprocating piston shafts 32 of the hydraulic cylinders 33 will be midway in their reciprocating movement when the axes 37 of the tiltable drum units 23 are on a parallel horizontal plane with the frame girders 11. This mounting allows for vertical tilting of the drum units 23 approximately 5° on either side of said horizontal plane without interference with any part of the cranes frame structure, as distinctly shown in FIG. 1 of the drawings. It should be recognized that the drum units may be tilted approximately 10° either side of the horizontal plane and still fall within the scope of this invention.

Drums 24 with their integral end flanges 24′ and 24″ may be rotated in a clockwise or counter-clockwise direction about their central axes 37 and their center shaft mountings 25 by means of internal gears (not shown) which are enclosed in the gear housings 26 and are driven by the integrally attached hydraulic motors 27. Hydraulic motors 27 are driven by hydraulic pressure eminating through flexible hoses 39, junction boxes 40 and fixed pipe lines 41. Hydraulic pumps 42 provide the necessary pressure required to rotate drums 24 in either direction and control their speed and direction or rotation by means of direct association with a servo-mechanism 43 and the usual diesel engines 44, all of which power drive components are mounted preferably in side by side relation on the top surface of the cover plate 12, at the right end thereof and are connected by suitable cables 45 and hydraulic lines 46 to an operator's console 47. Console 47 is mounted on the cover plate 12, adjacent the other end thereof and contains the necessary operating levers, knobs, meters and other indicia in full view and reach of an operator whom is stationed on a platform 48 that is supported by structural members directly below the girders in horizontal relation thereto. A rectangular recess or cut-out portion of the cover-plate 12 is located directly between the pair of tiltable drum units 23 for close observation and accurate control of the drum speed, their direction of rotation and the tilting action of said units, in unison, by the operator.

The two way hydraulic cylinders 33 which are utilized to provide the controlled tilting action of the drum units are connected to the operator's console by flexible hoses 49 one of which is connected to the upper ends of the cylinders, the other of which is connected to the lower ends of the cylinders to allow for free radial movement of the same about their pivot points 34 in the depending support brackets 35. This mounting allows the operator to change the vertical direction and degree of drum tilt by manipulation of suitable levers 50 on the face of the operator's console 47 that through suitable valves in the console (not shown) and the flexible hoses 49, control the movement of the cylinder's piston shaft 32, as required.

The operator's console is also provided with a pair of levers 51 that are conveniently located on the sides of the same and are connected through suitable valves, hydraulic lines, cables etc; to the servo mechanisms 43, hydraulic pump 42, hydraulic motors 38 and the driven gears which may be actuated by the operator to simultaneously control and govern the direction of rotation of the drums 24, to thereby lift or lower the load 20 by the winding or unwinding of the wire rope lines 21 on to or from the drums.

A pair of pump speed indicating tachometers 52 allow the operator to regulate the speed (or R.P.M.) of the rotatable drums by means of the servo control levers 51. A pair of hydraulic pressure (P.S.I.) indicators 53 remotely associated with the power drives of the separate tiltable drum units 23, and a pair of line footage indicators 54 are mounted in horizontal, side by side relation on the face of the operator's console. Indicators 54 display by means of visible numbers or digits the exact footage of wire rope being wound or unwound from the drums which are automatically transmitted by suitable roller driven odometers, the rollers 55 of which are always in contact with the separate, identical running lines 21 of each drum system (as shown in FIG. 3 of the drawings). They thereby measure the line footage being hauled in or out and the operator by observation may keep the numbers or digits in cadence thereby maintaining absolute parallism of the equalizer beam 17 and hence level lifting or lowering of the load 20.

OPERATION

The use and operation of the tiltable drum units of the present invention and their associated components in conjunction with the commonly used components of a conventional crane or hoisting system will become evident from the following description of their use and operation.

The operator stationed on platform 48 between the pair of tiltable drum units 23, starts the diesel engine 44, which through their associated hydraulic pumps 42, servo mechanisms 43 and hydraulic motors 27 supply oil or other hydraulic fluid under pressure to the motors which furnish the power to drive the internal gear mechanisms in the gear housings 26 to rotate the drums 24 in opposite directions, at controlled speeds about their respective axes 47. The drum units are tilted up or down in a vertical plane by means of the hydraulic two-way cylinders 33 which are connected to suitable valving in the operators console 47, all of which functions may readily be performed upon operator commands as he observes the conditions necessitating actions and he adjusts the controls on the console to comply.

In order to lift a heavy load from the ground or other surface to the necessary height required to clear obstacles such as a high wall or other building structure, and lower it to the desired position, keeping the load substantially level during the entire operation, and to perform the task with safety and little wear on the moving component parts of the hoisting system, the operator should proceed as follows:

After starting the diesel engines, first disengage the safety brakes and ratchet to thus allow the weight of the equalizer beam 17 with its rotating swivel 18, lifting hook 19, traveling blocks 15 and fairlead sheave blocks 16 to withdraw the wire rope as the operator pushes the control lever causing rotation of drums 24 and the unwinding of the several layers of the wire rope running line 21 that are stored thereon from the drums. This action allows the equalizer beam with its lifting hook to be lowered the required distance for picking up the load. The operator observes and tilts the drum units up or down as required witin the maximum of 5° either side of their horizontal relation to maintain the desired perpendicularity of the lines with the axes of the drums as the several layers of wire rope are being unwrapped from the drums.

When the equalizer beam 17 with its lifting hook 19 is lowered a sufficient distance to pick up the load 20 in readiness for the lifting operation, the fairlead sheave guides 16 would assume their lowermost position (as indicated in dotted-line in FIG. 1). The fleet angle of the lines approaching the drums would be much greater than the desired 90° maximum were it not for the fact that the drum units 23 had been tilted downwardly about their points of pivot 30 at the command of the operator by causing the reciprocating piston shafts 32 of the hydraulic cylinders 33 to assume a lower position. This action tilts the axes of the drum units on their pivots 30, if required, to a maximum of 5° to begin the lifting operation of the load with the fleet line angles of the wire rope lines 21 being normal or in perpendicular relationship to the axis of the drums. As previously stated, this is the most desirable condition that can be obtained to permit tight, parallel, even wrapping of several layers of wire rope on the drums.

As the load is being lifted by the powered rotation and consequent wrapping of the wire rope on the drums, the operator maintains the perpendicular relationship of the running lines to the axes of the drums as they travel longitudinally along the cylindrical surfaces of the drums as the wrapping action takes place. This result occurs by gradually tilting the drum units upwardly until their axes is on a horizontal plane. All this time, the running lines (as shown in full lines in FIG. 1) assume a natural, perpendicular relationship with the axes 47 of the drums. If the fleet angle thereof would increase to more than the desired 90° of perpendicularity by as much as 1¼° (as indicated in the right hand dotted line in FIG. 1), the operator abruptly changes the direction and degree of tilt so that the wire rope being wrapped on the drums changes its direction of travel (as shown in the A and B views of FIG. 5) by crossing over the last row of winding to resume its controlled winding in the opposite direction. With the operator continuing this procedure until sufficient layers of rope are wrapped on the drums, in somewhat pyramidal fashion, the load can be lifted to the limit of its height without any components of the hoisting system coming into contact with the rotating drums.

The tilting movement of the drum units 23 is small or not required when the fleet angle is less than 1¼° (i.e., the traveling blocks 15 are more distant than 20 times the width of the individual drums). As this distance decreases, tilting of the drum units axes to maintain perpendicularity of the running lines as they travel across the face of the drum barrels, is required to allow full level layers of wire rope to be wound tightly on the drums.

The embodiment of the present invention shown in the drawings and described in this specification comprises two independent pivoted tiltable drum unit assemblies that are mounted on the single frame of a conventional crane of a hoisting device that perform their functions of lifting or lowering a specific load, by a single operator standing or sitting on a depending platform disposed directly between the two drum units. It should be understood that a single tiltable drum unit could be utilized in conjunction with the hoisting system of a conventional light-duty crane to obtain similar safe and efficient results.

Although but one embodiment of the invention has been shown and described, it will be obvious to those skilled in the art that various changes and modfications may be made therein without departing from the spirit of the invention and the scope of the appended claims.

What is claimed is:

1. A hoisting device for controlling the deflections of its load carrying line on a pair of power driven rotatable drums comprising:

a frame means having a pair of columns and supporting a cross-beam assembly, a pair of traveling block means arranged for substantially vertical movement and comprising an equalizer beam means therebetween for supporting a load therefrom, a pair of line receiving drums rotatably mounted on said frame between said columns for receiving and dispersing load carrying lines, said pair of traveling block means being positioned between said pair of drums and said equalizer beam means, a load carrying line for winding on to and off of each of said drums, one end of each line being secured to an associated drum and the other end threaded around an associated traveling block means, and dead ended on a selected anchoring means, operator actuated means for tiltably mounting each of said drums, said means comprising a first pivot means for supporting one end of a drum for pivotal movement of the drum about a given point and tilting means for supporting the other end of the drum, said tilting means causing lateral movement of said other end of said drum a given distance vertically each side of a substantially horizontal position thereof to properly and tightly wind and unwind said line in multiple layers from the drum during load lifting and lowering operations, and means for selectively rotating each of said drums.

2. The hoisting device set forth in claim 1 wherein:

said tilting means comprises a second pivot means for mounting said other end of said drum, and power means for selectively moving said second pivot means laterally of its substantially horizontal position.

3. The hoisting device set forth in claim 2 wherein:

said power means comprises a hydraulic cylinder.

4. The hoisting device set forth in claim 1 wherein:

said tiliting means is capable of tilting said drum up to approximately 10° either side of said horizontal position.

5. A hoisting device for controlling the deflections of its load carrying lines on a pair of power driven rotatable drums comprising:

frame means supporting a cross-beam assembly, at least two traveling block means arranged for substantially vertical movement and having an equalizer beam means suspended therebetween for supporting a load therefrom, at least two line receiving drums rotatably mounted on said frame for each receiving and dispersing a load carrying line, said traveling block means being positioned between said drum and said equalizer beams, a pair of load carrying lines one for each of said drums for winding on to and off of the associated drum, one end of each of said lines being secured to a different one of said drums and the other end of each line being threaded around a different one of said traveling block means operator controlled means for tiltably mounting each of said drums, said means comprising a first pivot means for each of said drums for supporting one end of each of said drums for pivotal movement of the drums about a given point, and tilting means for supporting independently the other end of each of said drums, said tilting means causing lateral movement of said other end of each of said drums a given distance vertically each side of a substantially horizontal position thereto to evenly wind and unwind the line in multiple layers independently from each of said drum during load lifting and lowering operations, and means for selectively rotating and tilting said drums independently of each other.

6. The hoisting device set forth in claim 5 wherein:

said tilting means causes lateral movement of each of said drums independently of the other.

7. The hoisting device set forth in claim 5 wherein:

said tilting means for each of said drums comprises a second pivot means for mounting said other end of each of said drums, and power means for each of said drums for selectively moving said second pivot means for each of said drums laterally of its substantially horizontal position.

8. The hoisting device set forth in claim 5 wherein:

said tilting means is capable of tilting each of said drums up to approximately 10° either side of their horizontal positions.

9. The hoisting device set forth in claim 5 in further combination with:

means for indicating the amount of line movement past a given point so that uniform increments of line movement will result in maintaining level alignment of the load beam.

* * * * *